United States Patent [19]

Johnson

[11] Patent Number: 4,510,556

[45] Date of Patent: Apr. 9, 1985

[54] ELECTRONIC LIGHTING APPARATUS FOR SIMULATING A FLAME

[76] Inventor: David C. Johnson, 4190 Rochester Rd., San Diego, Calif. 92116

[21] Appl. No.: 557,347

[22] Filed: Nov. 30, 1983

[51] Int. Cl.[3] ..... F21V 33/00

[52] U.S. Cl. ..... 362/184; 362/208; 362/252; 362/311; 362/363; 362/802; 362/810

[58] Field of Search ..... 362/184, 208, 252, 311, 362/363, 802, 810

[56] References Cited

U.S. PATENT DOCUMENTS

| | | | |
|---|---|---|---|
| 3,145,323 | 8/1964 | Klotz | 362/810 |
| 3,368,107 | 2/1968 | Skirvin | 362/810 |
| 3,384,774 | 5/1968 | English | 362/810 |
| 3,435,286 | 3/1969 | Kayatt | 362/810 |
| 3,500,126 | 3/1970 | Ford | 362/810 |
| 4,074,165 | 2/1978 | Moriyama | 362/810 |

*Primary Examiner*—Stephen J. Lechert, Jr.
*Attorney, Agent, or Firm*—Robert W. Weig

[57] ABSTRACT

An electronic lighting device for simulating a flame, particularly a candle flame. In the preferred embodiment a set of three vertically spaced lamps are enclosed in a translucent bulb and are controlled by a signal generator circuit which independently turns three lamps on and off in a manner which simulates both the illumination distribution and the gas turbulence in a natural flame. The circuit includes a multistage static shift register which is used in a feedback mode to produce three mutually delayed pseudo-random pulse trains. One pulse train is used directly to control the uppermost lamp. The other pulse trains are combined with assymetric long-duty-cycle and short-duty-cycle clock signals. The resulting combined signals are used to drive the lower and middle lamps, respectively. The net result is that the lowermost lamp is brightest and flickers only dimly; the middle lamp is of intermediate brightness and appears to flicker more distinctly; and the upper lamp is on half the time and off half the time, on average, with the average brightness being less than either of the lower lamps and the flickering effect being more pronounced than that of either the lower or middle lamps.

7 Claims, 3 Drawing Figures

ELECTRONIC LIGHTING APPARATUS FOR SIMULATING A FLAME

BACKGROUND OF THE INVENTION

The invention described herein is generally related to electrical lighting apparatus, and more specifically is related to decorative electrical lighting devices which simulate candles or other natural flames.

It has previously been known to provide decorative electrical lighting devices which automatically switch on and off in a manner intended to simulate a flickering flame. Various electrical circuits and electromechanical means have been used to achieve this effect in a simplified form. However, the characteristic appearance of a natural flame arises from certain illumination intensity variations and gas turbulence effects which are not easily reproduced in simple lighting devices of the type previously known. To some extent these effects have been sought to be reproduced in multi-filament light bulbs which flicker on and off in various ways. However, there has not been previously available a lighting apparatus containing multiple lighting elements which flicker in a manner that realistically simulates both the gas turbulence and the illumination intensity distribution that are characteristic of a burning flame.

Accordingly, it is the object and purpose of the present invention to provide an improved electrical lighting apparatus for simulating a natural flame.

It is a more specific object of the present invention to provide a lighting apparatus which simulates both the turbulent gas flow and the illumination intensity distribution of a natural flame, particularly a candle flame.

It is another object of the present invention to provide a lighting apparatus which includes, in a single bulb unit, multiple lighting elements which are arranged and independently actuated to switch on and off in a random manner which simulates both the gas turbulence and illumination intensity distribution of a natural flame.

It is also an object of the present invention to provide digitally controlled electronic circuitry to drive the multiple lighting elements of the above-mentioned lighting apparatus.

SUMMARY OF THE INVENTION

The foregoing as well as other objects and purposes are attained in the lighting apparatus of the present invention, which includes a bulb assembly consisting of a plurality of vertically spaced electric lamps which are preferably enclosed in a suitable translucent bulb having the general shape of a natural flame. Each lamp is actuated under the control of a control signal which turns the lamp on and off in a pseudo-random manner described further below. The control signals are generated by a control signal generator circuit which produces a different control signal for each lamp. The control signals applied to the lamps are different in certain characteristics which result in the assembly of lamps simulating both the illumination intensity distribution and the gas turbulence of a natural flame. The illumination intensity distribution is obtained by varying the control signals such that the average proportion of time during which the lamps are actuated increases toward the lowermost of the lamps. This results in the average illumination intensity increasing toward the base of the assembly, just as the average illumination intensity increases toward the base of a natural flame where the combustion rate is greatest. At the same time, the control signals are also varied so as to randomly and intermittently turn the lamps off for periods of time which are of varying frequency and duration, but which, on the average, are of progressively increasing duration toward the top of the assembly. This results in a flickering effect which is more pronounced toward the top of the assembly, just as the flickering of a natural flame is more pronounced toward the top of the flame where the gas turbulence is greatest.

In the preferred embodiment, and in accordance with other aspects of the invention, the control signals are generated in part by means of a multi-stage static shift register which is employed in a feedback mode to produce a pseudo-random pulse train of suitable average frequency and pulse width. The shift register is tapped at several stages, corresponding to the number of lamps in the assembly, so as to produce a set of pulse trains which are delayed with respect to one another, and which are used to form the control signals for the lamps. In the preferred embodiment, one of the pulse trains is used directly to control the uppermost lamp of the assembly. The other pulse trains are combined with a set of assymetric clock signals having progressively increasing duty cycles so as to produce a set of control signals that are biased toward progressively increasing average duty cycle duration, yet which retain an element of randomness as a result of the pseudo-random pulse train component. The latter control signals are applied to other lamps of the assembly, with the control signals having the longest average duty cycle duration being applied respectively to the lowest lamps in the assembly.

These and other aspects of the present invention will be more apparent upon consideration of the following detailed description and accompanying drawings of a preferred embodiment of the invention.

BRIEF DESCRIPTION OF THE DRAWINGS

The accompanying drawings are incorporated in and constitute a part of the specification. The drawings illustrate various aspects of a preferred embodiment of the invention, and are provided for the purpose of accompanying the following detailed description of the invention and its operation. In the drawings.

DETAILED DESCRIPTION OF THE PREFERRED EMBODIMENT

The preferred embodiment of the invention illustrated in the Figures and described in detail below is the best mode of the invention contemplated by the inventor and is described for the purpose of enabling one of ordinary skill in the art to make and use the invention.

Figure 1:
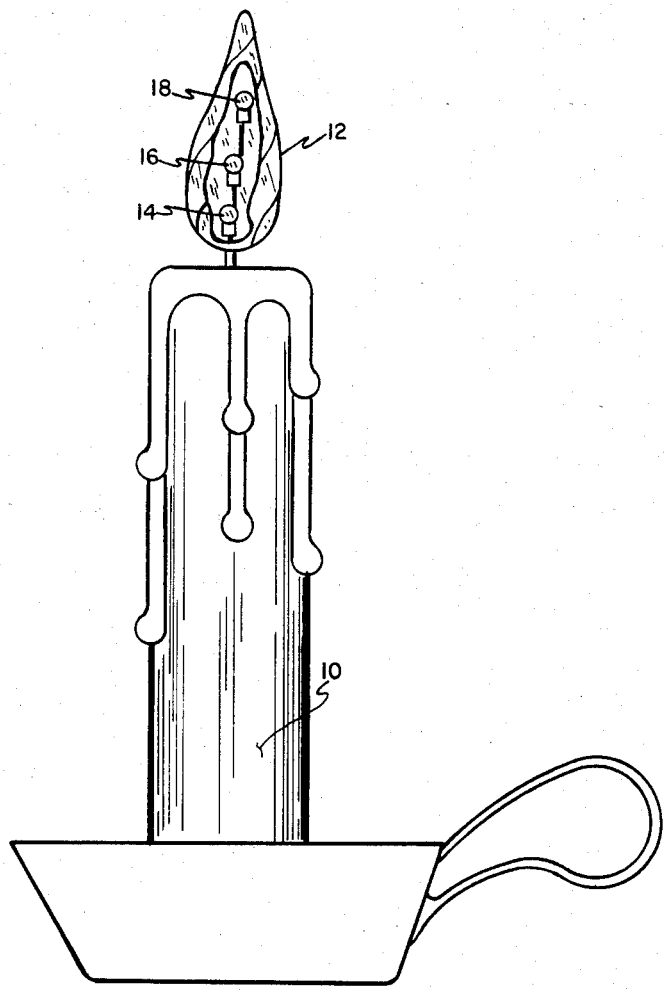
FIG. 1 is a pictorial illustration of an electronic candle made in accordance with the present invention.

Referring to FIG. 1, the electronic candle includes a generally tubular housing 10 which is designed to resemble a candle and which encloses all of the electronic circuitry described below and illustrated schematically in FIG. 2. Atop the housing 10 is a hollow translucent bulb 12 having an elongated free-form shape generally resembling that of a candle flame. The bulb 12 encloses three lamps 14, 16 and 18. The lamps 14, 16 and 18 are positioned in a spaced-apart vertical arrangement, with the the lamp 14 being near the base of the bulb 12, lamp 16 being near the middle, and lamp 18 being near the upper tip of the bulb 12. As discussed below, the three lamps are driven by the electronic circuitry so as to flicker on and off in a manner which simulates both the gas turbulence and the illumination intensity distribution of a natural candle flame.

Figure 2:
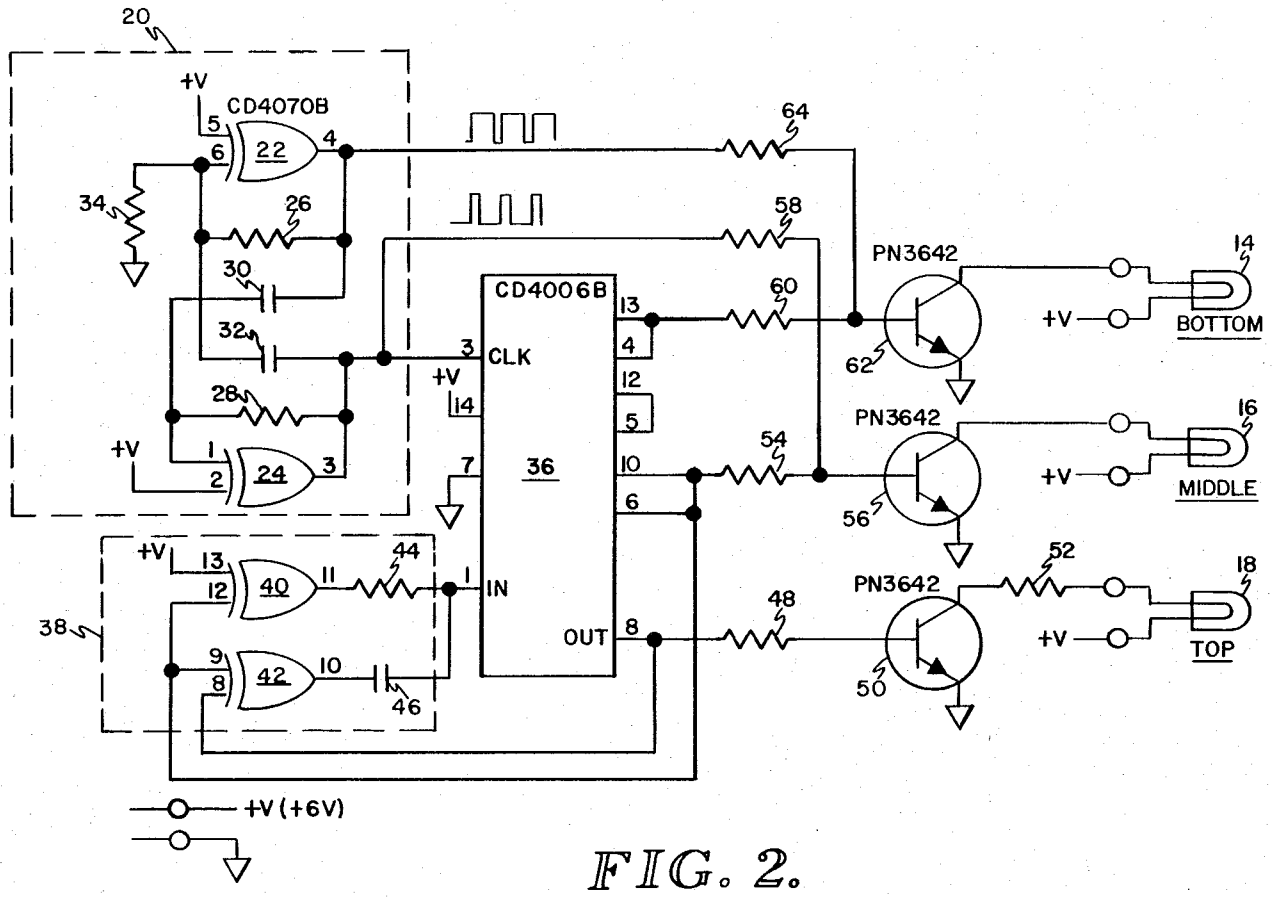
FIG. 2 is a schematic electrical circuit diagram of the internal circuitry used to drive the lamps of the electronic candle.

The circuitry described below and illustrated in FIG. 2 is driven by a 6-volt dc power supply which may be of any suitable configuration. All of the circuitry shown in FIG. 2 can be conveniently incorporated on a printed circuit board approximately $1 \times 1.5$ inches in dimension, using commercially available miniature integrated circuits, thereby enabling the circuitry to be completely contained in a candle such as that shown in FIG. 1.

Referring to FIG. 2, the circuitry that drives the lamps 14, 16 and 18 includes a clock circuit 20 which consists of two exclusive OR gates 22 and 24, two 330 kilohm resistors 26 and 28, two 0.1 microfarad capacitors 30 and 32, and a 180 kilohm resistor 34. These components are arranged in the manner of an assymetrical multivibrator to provide two clock signals, which are discussed below. The exclusive OR gates 22 and 24 are embodied as two gates (accessed by pins 1 through 6, as indicated in FIG. 2) of a four-gate integrated circuit (IC) which is identified in the industry by the designation CD4070B and which is commercially available from a number of major electronics manufacturers. The third and fourth gates of the IC are utilized in a start-up circuit described below.

The gate 22, resistor 26, and capacitor 30 operate to produce an approximately 40 Hz clock signal at the output of the gate 22, which is pin 4 of the CD4070B IC. The gate 24, resistor 28 and capacitor 32 likewise operate to produce a 40 Hz clock signal at the output of the gate 24, which is pin 3 of the IC. The resistor 34 operates to render each of the clock signals assymetrical. More specifically, the output of gate 22 is a long-duty-cycle clock signal, having a duty cycle of approximately 75 percent, and the output from gate 24 is a short-duty-cycle clock signal, having a duty cycle of approximately 25 percent. These clock signals are illustrated in the timing diagrams of FIGS. 3(*c*)(*i*) and 3(*b*)(*i*), respectively, and are further discussed below. The long- and short-duty-cycle clock signals are applied in the manner described below to control both the periodicity and intensity of illumination of the three lamps 14, 16 and 18.

The circuitry of FIG. 2 further includes an 18-stage static shift register (or delay line) 36, which is embodied in a commercially available integrated circuit identified in the industry by the designation CD4006B. The shift register 36 operates at the 40 Hz frequency of the clock circuit 20, with the short-duty-cycle clock signal from clock gate 24 being applied to the clock input (pin 3 of the CD4006B IC) of the shift register.

The shift register receives as an input a signal (high or low logic state) on input pin 1 and produces output pulse trains on pins 8, 10 and 13. The pulse train emitted at pin 8 represents a 17-stage delay tap; the pulse train emitted at pin 10 represents a 13-stage delay tap; and the pulse train at pin 13 represents a 4-stage delay tap. Thus, a signal (high or low) applied at pin 1 is emitted at pin 8 after a period of 17 clock cycles (approximately half a second); and is emitted at pin 10 after 13 clock cycles; and is emitted at pin 13 after 4 clock cycles.

The input signal that is applied to pin 1 of the shift register 36 is generated by a feedback-controlled start-up circuit 38, which consists of a pair of exclusive OR gates 40 and 42, a one-megohm resistor 44, and a 0.1 microfarad capacitor 46. The OR gates 40 and 42 are embodied in the four-gate CD4070B integrated circuit described above with reference to the clock circuit 20, and are accessed through pins 8 through 13 of the IC.

The OR gate 40 receives as one input the constant +6 volt power supply signal (at pin 13) and as its other input the pulse train (at pin 12) from the 13-stage tap of the shift register 36 (pin 10 of the shift register). The output of the OR gate 40 is applied through the one-megohm resistor 44 to the input pin 1 of the shift register. The OR gate 42 receives as inputs the pulse trains from the 17-stage tap (pin 8) and the 13 stage tap (pin 10) of the shift register 36. The output of the OR gate 42 is applied through the 0.1 microfarad capacitor 46 to the input pin 1 of the shift register 36. In this manner, the logical outputs of the gates 40 and 42 are summed to produce the input signal to the shift register.

The start-up circuit 38 serves three purposes. First, it provides an initial start-up signal to the shift register when the system is turned on. Secondly, it functions as a pseudo-random signal generator to apply a pseudo-random pulse train to the input of the shift register. Finally, the start-up circuit ensures that, in the event the output signals from the 17- and 13-stage taps of the shift register are both low, the input signal to the shift register does not go low and stay low. More specifically with regard to the latter function, if the outputs of the 17- and 13-stage taps are both low, the combination of the OR gates 40 and 42 operates to provide a high signal to the input of the shift register 36, thereby preventing the shift register outputs from thereafter remaining low.

It will be recognized that the output pulse trains from the 4-, 13- and 17-stage taps of the shift register 36 are identical in their respective random sequences of logical high and low logic states, but are delayed with respect to one another by constant periods of time which are represented by the different delay times of the taps. The output of each tap consists of a pseudo-random pulse train of logical high and low signals, with the signals changing in a random fashion between high and low at the clock frequency of approximately 40 Hz.

Figure 3:
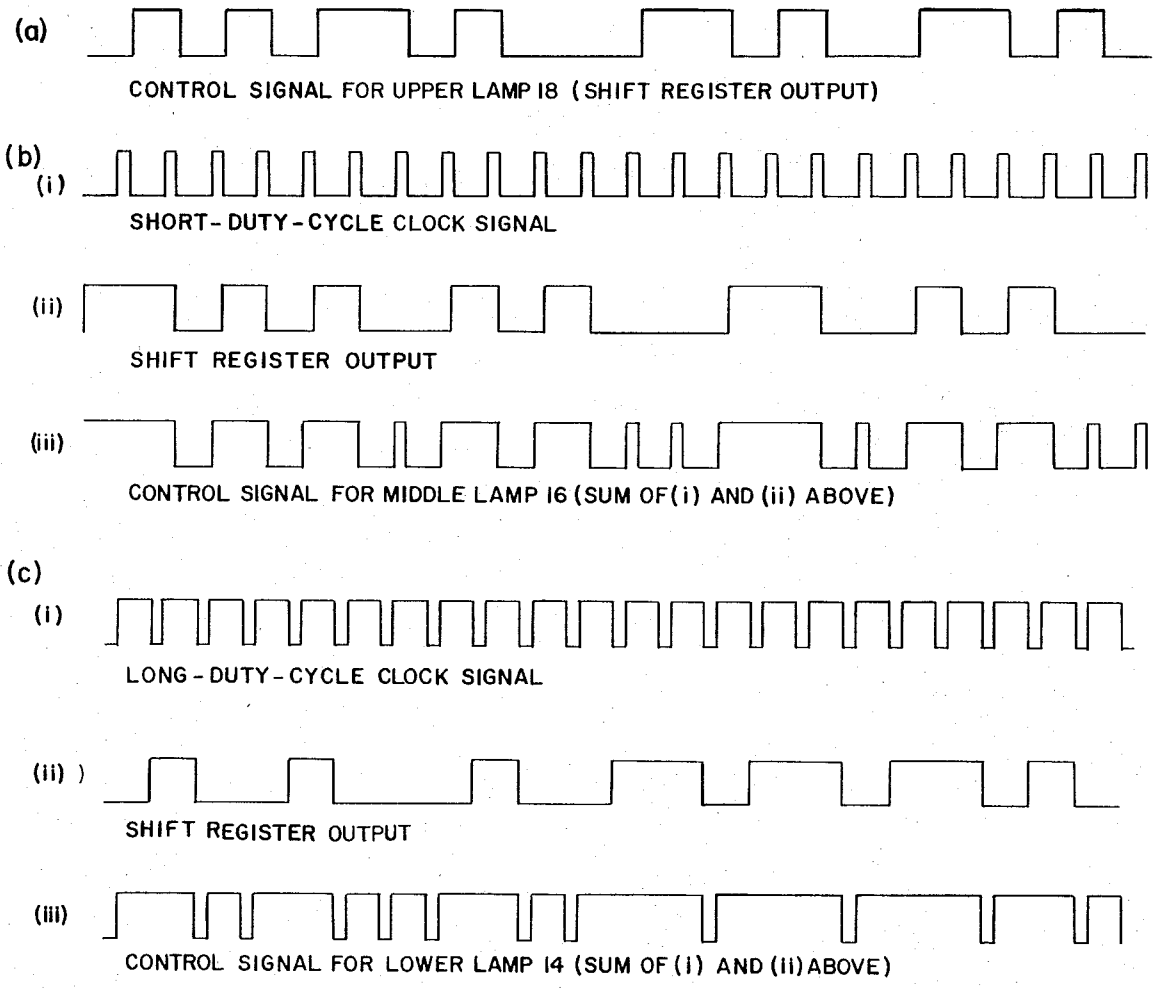
FIG. 3 is a timing diagram illustrating the nature of the control signals which drive the lamps of the candle.

The output of the 17-stage tap at pin 8 is applied through a 3-kilohm resistor 48 to the base of an npn switching transistor 50, which may be a PN3642 transistor. The emitter of the transistor 50 is grounded and the collector is connected through a 10-ohm resistor 52 to the upper candle lamp 18. Thus, the upper lamp 18, representing the tip of the candle flame, is turned randomly on and off under the control of the pseudo-random output pulse train from the 17-stage tap of the shift register. An example of this pulse train is shown in FIG. 3(*a*). It will be recognized that the upper lamp is actuated, on the average, approximately half the time as a consequence of the random on-and-off nature of the pulse train control signal.

The output pulse train from the 13-stage tap at pin 10 of the shift register 36 is applied through a 3-kilohm resistor 54 to the base of a second switching transistor 56 (also a PN3642). The collector of the second transistor 56 is connected to the middle candle lamp 16. The short-duty-cycle clock signal from OR gate 24 is also passed through a 3-kilohm resistor 58 to the base of the transistor 56. In this manner the short-duty-cycle clock signal and the pseudo-random pulse train from the shift register are summed to produced a control signal for the middle lamp 18. The short-duty-cycle clock signal and a representative example of the shift register output pulse train are shown in FIGS. 3(*b*)(*i*) and 3(*b*)(*ii*), together with the control signal (FIG. 3(*b*)(*iii*)) that is formed by summing the former two signals.

In a similar fashion, the output pulse train from the 4-stage tap of the shift register is applied through a 3-kilohm resistor 60 to the base of a third switching transistor 62 (also a PN3642). The collector of the transistor 62 is connected to the lower candle lamp 14. The long-duty-cycle clock signal is also applied through a 3-kilohm resistor 64 to the base of the transistor 62, such that the control signal for the lower lamp consists of the sum of the long-duty-cycle clock signal and the pseudo-random output pulse train from the shift register. The long-duty-cycle clock signal, a representative example of the the shift register pulse train, and the summed control signal are illustrated in FIGS. 3(*c*)(*i*), 3(*c*)(*ii*) and 3(*c*)(*iii*), respectively.

It will be noted upon examination of FIG. 3 that the lamp control signals (FIGS. 3(*a*), 3(*b*)(*iii*) and 3(*c*)(*iii*)) have certain characteristics which result in illumination levels and flickering effects that simulate a natural flame. For example, the control signal for the upper lamp is in a logical high state, on the average, exactly half the time. The control signals for the lower and middle lamps are in the logical high state a greater proportion of the time, since they are formed by summing the shift register output signal with the clock signals. In this regard, the lower lamp control signal is, on the average, in the logical high state the greatest proportion of time, since it is the sum of the shift register output signal and the long-duty-cycle clock signal. Further, the average time period between successive high logic states decreases from the upper lamp to the lower lamp. This results in the lower lamp being on most of the time, with only relatively occasional and brief periods during which it is off. In actuality, the flicker rate of the lower lamp is nevertheless sufficiently high that it appears to flicker between a bright state and a somewhat less bright state, rather than flickering distinctly on and off. The middle lamp is also on most of the time, but not as much as the lower lamp, and has relatively longer and more frequent periods during which it is off. Again, however, because of the relatively high average frequency of the control signal, the middle lamp in actuality appears to flicker between an intermediate intensity level and a somewhat higher intensity level, with the average rate of the flickering being somewhat higher than that of the lower lamp. The upper lamp appears to flicker on and off more distinctly than either the lower or middle lamp, with the average lengths of the periods during which the upper lamp is on and off being approximately equal in duration, and with the duration of the periods during which it is off being, on the average, longer than the average periods during which the lower and middle lamps are off. Additionally, the power to the upper lamp is reduced somewhat by the 10-ohm resistor 52, so that the average intensity of the upper lamp is somewhat less than that of the lower and middle lamps for this reason as well as for the reason that the average duration of the periods during which the upper lamp is off is somewhat longer for the upper lamp than for the other lamps. As a result, the upper lamp is less bright but is characterized by a more pronounced flickering effect than the lower and middle lamps.

The net result is a set of three lamps which simulate both the illumination intensity distribution and the gas turbulence of a a natural flame. The average illumination intensity increases toward the base of the apparatus, thus simulating the actual intensity distribution in a flame, which occurs as a result of the greater combustion rate near the base of the flame. At the same time, the flickering effect becomes more pronounced toward the top of the flame, thus simulating the greater gas turbulence that exists near the top of the flame.

The foregoing detailed description of a preferred embodiment of the invention is provided to enable one of ordinary skill in the art to make and use the present invention, and is not intended to limit the invention to the actual embodiment illustrated and described. Various modifications, alterations and substitutions which may be apparent to one of ordinary skill in the art may be made without departing from the spirit of the invention. Accordingly, the scope of the invention is defined by the following claims.

What is claimed is:

1. An electronic lighting apparatus for simulating a flame, comprising a plurality of electric lamps arranged vertically in spaced apart relationship, and control signal generator means for generating respective control signals for turning said lamps on and off in a manner so as to simulate both the illumination intensity distribution and the gas turbulence of a natural flame, said control signals operating to turn said lamps on and off in a random sequence, with the average proportion of time during which said lamps are turned on progressively increasing toward the lowermost of said plurality of lamps so as to obtain an average illumination intensity which progressively increases toward the lowermost of said plurality of lamps, and with the average duration of the intermittent periods during which said lamps are turned off decreasing progressively toward the lowermost of said plurality of lamps, whereby a flickering effect is obtained which is progressively more pronounced toward the uppermost of said plurality of lamps, thereby simulating the gas turbulence distribution of a natural flame.

2. The lighting apparatus defined in claim 1 wherein said control signal generator means for generating said lamp control signals includes a multistage static shift register employed in a feedback mode so as to produce a pseudo-random pulse train of suitable average frequency and pulse width, and wherein said shift register is tapped at a plurality of stages to produce a plurality of pseudo-random pulse trains which are delayed with respect to one another, clock circuit means for generating a plurality of assymetric clock signals of progressively increasing duty cycle, at least some of said plurality of pseudo-random pulse trains being combined respectively with said plurality of clock signals to generate a plurality of control signals which are applied to said lamps, with the control signals formed of clock signals having the longest duty cycles being applied progressively and respectively to the lowermost lamps of the lighting apparatus.

3. The lighting apparatus defined in claim 2 wherein pulse trains from selected stages of said shift register are summed to provide a pseudo-random feedback signal, said pseudo-random feedback signal being fed back as an input signal to said shift register so as to result in the output of each stage of said shift register being said pseudo-random pulse train, with the pulse trains from the various shift register stages being identical but delayed with respect to one another.

4. The lighting apparatus defined in claim 3 wherein there are three lamps, an upper lamp, a middle lamp and a lower lamp, and wherein said clock circuit generates a first assymmetric clock signal having a frequency of approximately 40 Hz and a duty cycle of approximately 75 percent, and a second assymetric clock signal having a frequency of approximately 40 Hz and a duty cycle of approximately 25 percent, and wherein said shift register is driven at said 40 Hz frequency of said clock signals, and wherein said lower lamp is controlled by a control signal consisting of the sum of said first assymetric clock signal and a pulse train from a first stage of said shift register, said middle lamp is controlled by a control signal consisting of the sum of said second assymetric clock signal and the pulse train from a second stage of said shift register, and wherein said upper lamp is controlled by a control signal consisting of the pulse train from a third stage of said shift register.

5. The lighting apparatus defined in claim 4 wherein said clock circuit comprises an assymetrical multivibrator.

6. The lighting apparatus defined in claim 2 wherein the pulse train outputs from at least two stages of said shift register are combined in a start-up circuit which produces a psuedo-random feedback signal that is applied to the input of the shift register, said start-up circuit also operating to provide a high logic state to the input of said shift register at start-up of the apparatus, and also operating to ensure that the outputs of the shift register do not go to and remain at a low logic state.

7. The lighting apparatus defined in claim 6 wherein said said start-up circuit comprises first and second exclusive OR gates, and first OR gate receiving as inputs said pulse train outputs from said two stages of said shift register and applying the resulting output signal through a capacitor to the input of said shift register, and wherein said second OR gate receives as one input the pulse train from one of said shift register stages and as the other input a constant voltage signal, the output signal of said second OR gate being applied through a resistor to the input of said shift register, whereby said pulse train outputs from said shift register are effectively combined to produce said pseudo-random feedback signal.

* * * * *

UNITED STATES PATENT AND TRADEMARK OFFICE

Certificate

Patent No. 4,510,556 Patented: Apr. 9, 1985

On petition requesting issuance of a certificate for correction of inventorship pursuant to 35 USC 256, it has been found that the above-identified patent, through error and without any deceptive intent, improperly sets forth the inventorship. Accordingly, it is hereby certified that the correct inventorship of this patent is:

David C. Johnson
Richard A. Gray

Signed and Sealed this 12th day of September 1989.

Brooks Hunt,
*Supervisory Patent Examiner*
*Group 220, Art Unit 224*